United States Patent [19]

Richmond

[11] Patent Number: 4,568,452

[45] Date of Patent: Feb. 4, 1986

[54] PROCESS FOR UPGRADING A CONTAMINATED ABSORBENT OIL

[75] Inventor: Robert P. Richmond, Baton Rouge, La.

[73] Assignee: Exxon Research and Engineering Co., Florham Park, N.J.

[21] Appl. No.: 621,190

[22] Filed: Jun. 15, 1984

[51] Int. Cl.[4] ..... C10G 21/00; C10G 45/00

[52] U.S. Cl. ..... 208/341; 208/92; 208/97; 208/211; 208/238; 208/254 H; 208/254 R; 208/216 R

[58] Field of Search ..... 208/216, 254 H, 254 R, 208/341, 238, 92, 97, 370, 347, 301, 302, 85, 251 H, 350, 354, 211, 348

[56] References Cited

U.S. PATENT DOCUMENTS

| | | | |
|---|---|---|---|
| 2,260,619 | 10/1941 | Hancock | 208/238 |
| 2,281,282 | 4/1942 | Gerhold | 208/350 |
| 2,335,162 | 11/1943 | Shiras | 208/350 |
| 2,353,176 | 7/1944 | Meyers | 208/350 |
| 2,472,810 | 6/1949 | Denig | 208/341 |
| 2,663,673 | 12/1953 | Kalinowski | 208/238 |
| 2,847,361 | 8/1958 | Hengstebeck | 208/238 |
| 2,913,374 | 11/1959 | Van Ackeren et al. . | |
| 2,922,751 | 1/1960 | Helm . | |
| 2,927,061 | 3/1960 | Stover . | |
| 2,976,229 | 3/1961 | Brown et al. | 208/238 |
| 3,137,135 | 1/1979 | Glassman et al. | 208/341 |
| 3,238,123 | 3/1966 | Voorhies, Jr. et al. | 208/254 H |
| 3,247,649 | 4/1966 | Miller | 208/341 |
| 3,412,171 | 11/1968 | Welch et al. | 208/341 |
| 3,687,734 | 9/1971 | Stafford, Jr. | 208/341 |
| 3,926,785 | 12/1975 | Siegel | 208/352 |
| 4,108,761 | 8/1978 | Sze et al. | 208/254 H |
| 4,287,051 | 9/1981 | Curtin | 208/254 |

*Primary Examiner*—John Doll
*Assistant Examiner*—Anthony McFarlane
*Attorney, Agent, or Firm*—Marthe L. Gibbons

[57] ABSTRACT

An absorbent hydrocarbonaceous oil comprising contaminants, such as sulfur and/or nitrogen, is upgraded by subjecting the contaminated absorbent oil to hydrorefining. The upgraded absorbent may be utilized again as absorbent.

6 Claims, 1 Drawing Figure

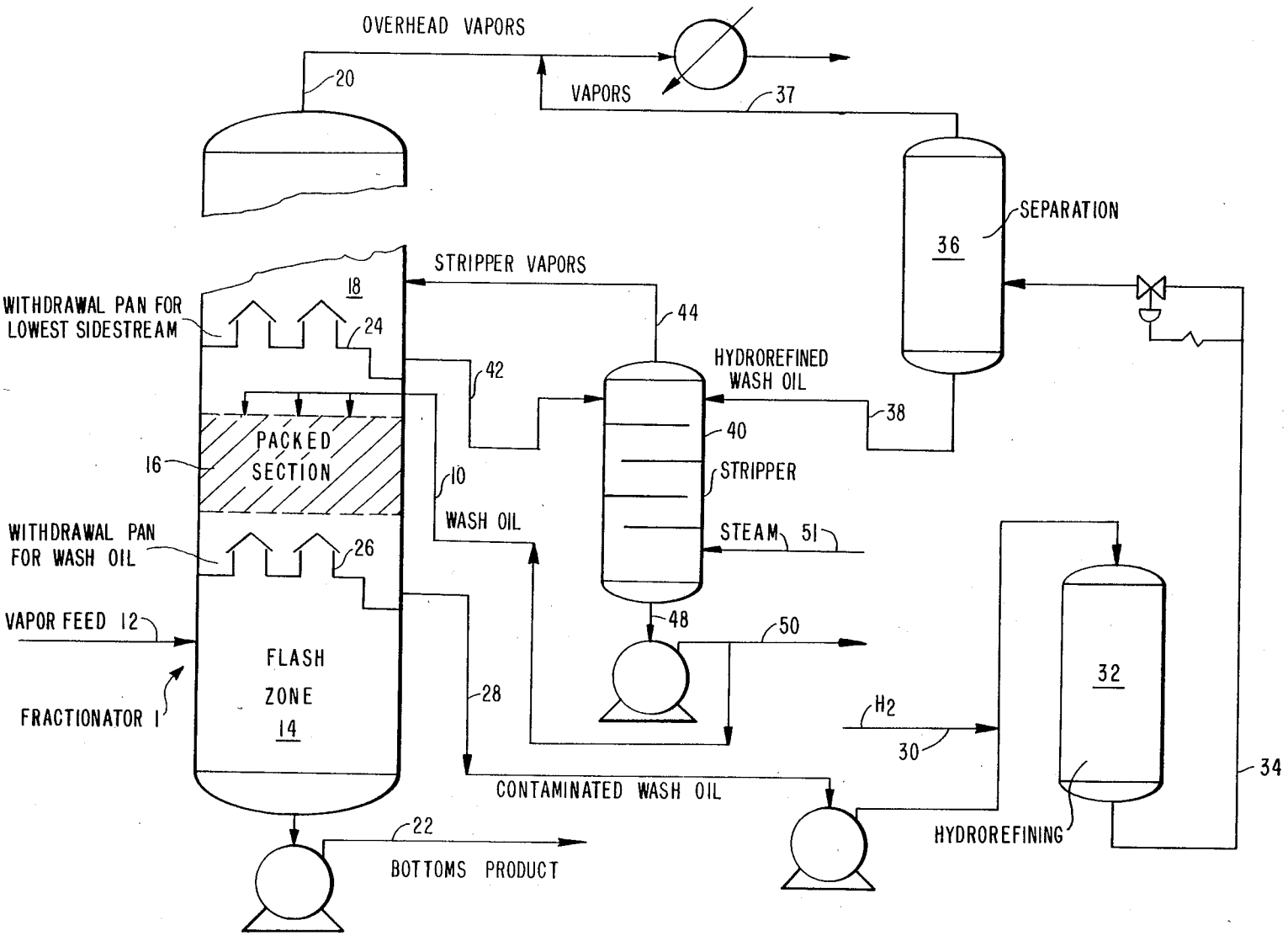
34
32
HYDROREFINING
SEPARATION
36
38
30
H2
37
HYDROREFINED WASH OIL
40
STRIPPER
STEAM
51
50
44
48
VAPORS
CONTAMINATED WASH OIL
STRIPPER VAPORS
42
10
WASH OIL
28
OVERHEAD VAPORS
22
BOTTOMS PRODUCT
20
18
24
26
PACKED SECTION
FLASH ZONE 14
16
WITHDRAWAL PAN FOR LOWEST SIDESTREAM
WITHDRAWAL PAN FOR WASH OIL
VAPOR FEED 12
FRACTIONATOR 1

PROCESS FOR UPGRADING A CONTAMINATED ABSORBENT OIL

BACKGROUND OF THE INVENTION

1. Field of the Invention

The present invention relates to a process for upgrading an absorbent hydrocarbonaceous oil containing contaminants such as sulfur or nitrogen.

2. Description of the Prior Art

In fractionation processes in which sulfur and/or nitrogen-containing hydrocarbonaceous oils are separated into fractions having different boiling points, it is known to introduce an absorbent oil into an absorption zone of the fractionator to contact the upflowing vapors of the feed to be separated and thereby remove at least a portion of the contaminants from the upflowing vapors by absorption in the absorbent oil, which is commonly known as wash oil. The absorption zone is typically positioned in the intermediate portion of the fractionator below the withdrawal pan of the lowest distilled sidestream product and above the flash zone into which the heated liquid and vapors are introduced into the fractionator. After performing its washing function in the intermediate section of the fractionator, the contaminated absorbent oil stream flows down through the flash zone into the fractionator bottoms product or it may be withdrawn by installation of a suitable withdrawal pan from the fractionator as a separate stream. When the absorbent oil is permitted to mix with the bottoms product, it becomes part of a lower value porduct. When the absorbent oil is withdrawn as a separate (i.e., discrete) stream, the contaminated absorbent oil has a low value since it is contaminated with the undesirable materials that are absorbed from the contaminated vapor stream that it had washed.

U.S. Pat. No. 2,472,810 discloses withdrawing a wash oil from a fractionator and passing it to a wash oil purifier. In the purifier, the wash oil is vaporized by steam from its non-volatile impurities. The purified wash oil is returned as a vapor to the fractionator.

U.S. Pat. No. 2,913,374 discloses withdrawing a wash oil from a stripping tower to a purifier. Stripping steam volatilizes the wash oil from a residue. The purified wash oil is returned to a stripping tower.

U.S. Pat. No. 2,922,751 discloses purifying a wash oil from a stripping tower in a purifier by steam volatilizing wash oil from the impurities. The purified wash oil is returned to the stripping tower.

U.S. Pat. No. 2,927,061 discloses purifying a rich absorption oil in a purifier by heating and then sending the vaporized rich oil to a still.

It has now been found that a contaminated absorbent oil can be upgraded by a hydrorefining process.

SUMMARY OF THE INVENTION

In accordance with the invention, there is provided a process for upgrading a hydrocarbonaceous absorbent oil containing a contaminant selected from the group consisting of sulfur, nitrogen and mixtures thereof, which comprises a step of contacting said absorbent oil with a hydrorefining catalyst in the presence of hydrogen at hydrorefining conditions to produce an upgraded absorbent oil having a decreased amount of said contaminant.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, an absorbent oil, commonly known as wash oil, is passed by line 10 into fractionator 1. The absorbent oil is a hydrocarbonaceous oil having an atmospheric pressure boiling point ranging from about 450 to about 1050° F., typically, from about 650° to about 1050° F. By way of example, suitable absorbent oils include heavy vacuum gas oil, heavy coker gas oil and the like. Preferably, the absorbent oil is a portion of the lowest distillate product stream of the fractionator. In fractionator 1, a hydrocarbonaceous feed is separated into fractions of different boiling points by distillation in the conventional manner known in the art. The hydrocarbonaceous feed may be a virgin hydrocarbonaceous oil or a hydrocarbonaceous oil product resulting from a hydrocarbon conversion process. The hydrocarbonaceous feed may be derived from any source, such as petroleum, shale oil, tarsand oil, products resulting from coal liquefaction, and mixtures thereof. These hydrocarbonaceous oils contain contaminants such as sulfur and/or nitrogen components and may also contain metallic contaminants. The hydrocarbonaceous feed is passed by line 12 into flash zone 14 of fractionator 1. The vapors flow upwardly from flash zone 14 into absorbent zone 16 positioned in an intermediate portion of fractionator 1 which is located below the withdrawal pan of the lowest distilled sidestream product and above the flash zone. Absorption zone 16 may comprise a packed section containing contacting means such as Glitsh grids, baffles, disc and donut, sheds, etc. In absorption zone 16, the absorbent oil that was introduced by line 10 contacts the sulfur and/or nitrogen-containing hydrocarbonaceous vapors for a time sufficient to remove at least a porton of the contaminants from the upflowing contaminant-containing hydrocarbonaceous vapor. Typical conditions in absorption zone 16 include a temperature ranging from about 680° F. to about 810° F. and a pressure rating from about 15 to 35 psig for atmospheric distillation or about 25 to 29 inches of mercury for vacuum distillation. The hydrocarbonaceous vapors having a decreased amount of contaminants then flow upwardly into fractionation zone 18 to be separated in a conventional manner. The fractionator overhead vapors are removed by line 20. The bottoms of the fractionator are removed by line 22. The pan for withdrawal of the lowest distillate sidestream is indicated at 24. The pan for withdrawal of the contaminants-containing absorbent oil is indicated at 26. The contaminants-containing absorbent oil is passed by line 28 in admixture with hydrogen introduced by line 30 into hydrorefining zone 32 which comprises a hydrorefining catalyst. By hydrorefining the contaminated absorbent oil in which the contaminants of the vapors from the flesh zone are concentrated, only the relatively small volume of contaminated absorbent oil needs to be treated. Since the contaminated absorbent oil is already at a temperature suitable for hydrorefining (by design of the fractionator) an additional heat source such as furnace may be omitted. Hence hydrorefining the absorbent at this point of the processing sequence minimizes energy expenditure. Other advantages of hydrorefining a contaminated absorbent oil are that the hydrorefined absorbent oil may be easily recombined with the lowest sidestream product through steam stripper and pump of the sidestream product and that gaseous products of the hydrorefining zone such as hydrogen sulfide, ammonia and naphtha can be disposed through the overhead system of the fractionator. The hydrorefining catalyst may be disposed in a fixed bed, moving bed, ebullated bed, fluidized bed, suspension (transferline). Preferably, the hydrorefining catalyst is disposed in a fixed bed. Suitable hydrofining catalysts include a hydrogenation component, such as a Group VIB and a Group VIII metal, metal oxide, metal sulfide and mixtures thereof, composited with a support. The catalyst may be, for example, a catalyst comprising cobalt, molybdenum, nickel, tungsten, and mixtures thereof on an alumina support, which may additionally comprise phosphorus and/or silica. Suitable catalysts are described, for example in U.S. Pat. Nos. 3,770,618; 3,509,044 and 4,133,656, the teachings of which are hereby incorporated by reference. The Periodic Table of Elements referred to herein is in accordance with the *Handbook of Chemistry and Physics,* published by the Chemical Publishing Company, Cleveland, Ohio, 45th Ed., 1964.

The term "hydrorefining" is used herein to designate a catalytic treatment in the presence of hydrogen of a hydrocarbonaceous oil to upgrade the oil by eliminating or reducing the concentration of contaminants in the oil, such as sulfur compounds, nitrogenous compounds, metal contaminants and/or partial saturation of the oil.

Suitable operating conditions in the hydrorefining zone are summarized in Table I.

TABLE I

| Conditions | Broad Range | Preferred Range |
|---|---|---|
| Temperature, °F. | 600–900 | 650–850 |
| Total pressure, psig | 600–3,500 | 800–3,200 |
| Liquid hourly space velocity (in fixed bed), v/v/hr | 0.05–5.0 | 0.1–2.5 |
| Hydrogen rate, scf/bbl | 300–20,000 | 600–12,000 |
| Hydrogen partial pressure, psig | 500–3,000 | 800–2,500 |

The hydrogen-containing gas introduced by line 30 into the contaminated absorbent oil may be pure hydrogen, but will generally be an impure hydrogen, such as a hydrogen-containing gas derived from a process, for example, reformer off-gas. Alternatively, the hydrogen-containing gas may be introduced directly into hydrorefining zone 32. In the hydrorefining zone, sulfur and nitrogen contaminants of the absorbent are converted at least in part to ammonia and hydrogen sulfide while the absorbent may also be partially hydrogenated. The hydrorefining zone effluent is removed by line 34 and passed to a gas-liquid separation zone, such as a low pressure flash drum 36 where the hydrorefining zone effluent is separated into a gaseous phase, which includes a sulfur and/or nitrogen contaminant, such as hydrogen sulfide and ammonia, and a normally liquid phase, which includes the upgraded absorbent oil having a decreased amount of contaminants. The upgraded absorbent oil is passed by line 38 to stripping zone 40 in which the lowest distillate sidestream of the fractionator is introduced by line 42. The stripping zone is conventionally utilized to remove vapors from the fractionator sidestream for recycle to fractionator 1 by line 44. A stripping gas, such as steam is introduced into stripping zone 40 by line 51. The stripped oil is removed by line 48. A portion of the stripped oil may be recovered as product by line 50. At least a portion of the stripped oil is recycled by line 10 into fractionator 1 to function as the absorbent oil in the absorption zone. The overhead vapors of flash drum 36 are removed by line 37 and may be combined with the overhead 20 of fractionator 1 for further processing in a conventional manner.

The process of the present invention permits upgrading the contaminated absorbent oil while minimizing energy expenditure.

What is claimed is:

1. In a fractionation process comprising an absorption zone wherein a hydrocarbonaceous absorbent oil having an atmospheric pressure boiling point ranging from about 650° F. to about 1050° F. is introduced to contact hydrocarbonaceous vapors containing a contaminant selected from the group consisting of sulfur, nitrogen and mixtures thereof to remove at least a portion of said contaminant from said hydrocarbonaceous vapors, and thereby produce an absorbent hydrocarbonaceous oil containing said contaminant and withdrawing said absorbent hydrocarbonaceous oil containing said contaminant from said absorption zone, the improvement which comprises contacting said withdrawn absorbent hydrocarbonaceous oil having a boiling point ranging from about 650° F. to about 1050° F. containing said contaminant with a hydrorefining catalyst in the presence of hydrogen in a hydrorefining zone at hydrorefining conditions to produce an upgraded absorbent oil having a decreased amount of said contaminant and recycling said upgraded absorbent oil to said absorption zone.

2. The process of claim 1 wherein said hydrorefining conditions include a temperature ranging from about 600° to about 900° F. and a total pressure ranging from about 600 to about 3,500 psig.

3. The process of claim 1 wherein said hydrorefining catalyst comprises a hydrogenation component selected from the group consisting of Group VIB metal component and a Group VIII metal component.

4. The process of claim 1 wherein said absorbent oil containing said contaminant has a temperature ranging from about 680° F. to about 810° F.

5. In the process of claim 1 wherein a hydrocarbonaceous feed is separated into fractions in a fractionation zone and wherein a separated fraction is passed to a stripping zone to remove vapors from said fraction, the further improvement which comprises passing said upgraded absorbent to said stripping zone to mix with said separated hydrocarbon fraction and, thereafter, recycling at least a portion of the resulting stripped oil to said absorption zone as said absorbent.

6. The process of claim 5 wherein said vapors are removed from said stripping zone and passed to an upper portion of said fractionation zone.

* * * * *